United States Patent [19]

Cundill

[11] 4,253,874

[45] Mar. 3, 1981

[54] ALLOYS STEEL POWDERS

[75] Inventor: Robin T. Cundill, Sheffield, England

[73] Assignee: British Steel Corporation, England

[21] Appl. No.: 942,276

[22] Filed: Sep. 14, 1978

Related U.S. Application Data

[63] Continuation of Ser. No. 738,627, Nov. 3, 1976, abandoned.

[51] Int. Cl.[3] ..... B22F 3/00; B22F 1/00

[52] U.S. Cl. ..... 75/246; 75/125; 75/126 C; 75/126 K; 75/126 R; 75/128 R; 75/128 P; 75/128 W; 75/0.5 C; 75/0.5 BA; 75/213; 148/126

[58] Field of Search ..... 75/125, 126 C, 126 K, 75/126 R, 128 R, 128 P, 128 W, 0.5 C, 0.5 RA, 213, 246; 148/126

[56] References Cited

U.S. PATENT DOCUMENTS

| | | | |
|---|---|---|---|
| 2,104,979 | 1/1938 | Finkl | 75/123 |
| 2,104,980 | 1/1938 | Finkl | 75/123 |

FOREIGN PATENT DOCUMENTS

| | | | |
|---|---|---|---|
| 551147 | 5/1941 | United Kingdom | 75/213 |

*Primary Examiner*—Brooks H. Hunt
*Attorney, Agent, or Firm*—Bacon & Thomas

[57] ABSTRACT

A finely divided annealed steel powder consisting by weight of up to 1.5% carbon, 1.0 to 2.0% chromium, less than 0.05% silicon, less than 0.1% manganese and either one or a combination of two or more of the following elements: 0.2 to 1.0% molybdenum, 0.2 to 1.0% nickel, up to 0.3% phosphorous and up to 1.0% copper, the balance, apart from impurities, being iron.

5 Claims, No Drawings

ALLOYS STEEL POWDERS

This is a continuation of application Ser. No. 738,627, filed Nov. 3, 1976, now abandoned.

This invention relates to hardenable chromium alloy steel powders and to the production of densified heat treated components from such powders. Examples of typical components are automotive products such as gears, shafts and bearings.

It is known to produce metal powder by causing jets of water to strike a freely falling stream of molten metal to atomise the same. Normally, the metal powder produced is subjected to an annealing treatment to improve compressibility; compacts produced from the powder are then sintered and for higher duty applications the sintered compacts may be densified by hot or cold working.

Typical heat treatable steels include elements such as silicon, manganese, chromium. If a melt of such a steel is water atomised, oxides are formed which are not reduced during subsequent sintering and which result in reduced ductility, impact strength and fatigue strength of components produced from the powder.

According to the present invention in one aspect, a finely divided annealed steel powder consists by weight of from 0.9 to 1.5% carbon, 1.2 to 2.0% chromium, less than 0.05% silicon, less than 0.1% manganese and either one or a combination of two or more of the following elements: 0.2 to 1.0% molybdenum, 0.2 to 1.0% nickel, up to 0.3% phosphorous and up to 1.0% copper, the balance, apart from impurities, being iron.

A preferred powder consists by weight of 0.9 to 1.1% carbon, 1.4 to 1.6% chromium, less than 0.02% silicon, less than 0.05% manganese, and either one or a combination of two or more of the following elements: 0.5 to 0.6% molybdenum, 0.5 to 0.6% nickel, up to 0.2% phosphorous and 0.5 to 0.6% copper, the balance, apart from impurities, being iron.

A method of producing a hardenable chromium alloy steel powder or compacts produced therefrom having an oxygen content of less than 250 parts per million (ppm) and a composition within the ranges specified in the preceding two paragraphs includes the steps of atomising a steel melt of the required chemical composition, annealing the powder produced in an atmosphere consisting wholly or essentially of hydrogen or dissociated ammonia at a temperature of 700° to 900° C. and sintering the powder or compacts produced therefrom in an atmosphere consisting wholly or essentially of hydrogen or dissociated ammonia having a dewpoint of no more than −10° C. at a temperature of 900° to 1300° C. The atmosphere may be enriched by the addition of carbon monoxide or a hydrocarbon gas such as ethane, methane, butane or propane.

Following annealing, graphite additions may be made to the powder to compensate for carbon losses which may occur during sintering. The graphite additions are typically of the order of 0.5 to 0.6% by weight. In certain instances, the initial carbon content of the steel may be minimal eg. 0.05% by weight, in which case a graphite addition of approximately 1.3% by weight would be necessary.

The annealed powder, with or without carbon additions, may be compacted to the required shape by isostatic pressing or die compaction.

According to the present invention in another aspect a method of manufacturing heat treated hardened components comprises the steps of atomising an alloy steel melt to produce a powder consisting by weight of from 0.9 to 1.5% carbon, 1.2 to 2.0% chromium, less than 0.05% silicon, less than 0.1% manganese and either one or a combination of two or more of the following elements: 0.2 to 1.0% molybdenum, 0.2 to 1.0% nickel, 0 to 0.3% phosphorous, and 0 to 1.0% copper, balance apart from impurities iron, annealing the powder in an atmosphere consisting wholly or essentially of hydrogen or dissociated ammonia at a temperature of between 700° and 900° C., producing one or more compacts from the annealed powder, sintering the compacts in an atmosphere consisting wholly or essentially of hydrogen or dissociated ammonia having a dewpoint of less than −10° C. at a temperature of between 900° and 1300° C. to reduce the oxygen content of the powder to less than 250 parts per million, densifying the sintered compacts to more than 99% of the theoretical density of the material and heat treating the densified components. Graphite additions may be made to the annealed powder to raise its carbon content to a level which after sintering will result in a carbon content in the range 0.8 to 1.2% by weight. Densifying of the sintered compacts may be effected by a hot pressing, rolling, forging or extrusion process.

The alloy steel powder is produced by impinging one or more high velocity water jets onto the surface of a stream of molten steel falling freely under gravity from a tundish. The chemical composition of the powder is generally of the same order as that required in the final product. Median particle sizes of the as-atomised powder is generally within the range 50 to 100 microns.

As mentioned previously, heat treatable chromium alloy steels conventionally include alloying elements such as silicon and manganese in substantial amounts, ie. 0.25% and 0.35% by weight respectively. If one produces a powder from such steels, the alloying elements form oxides during atomisation and the subsequent annealing treatment which are stable and difficult to reduce. As a result, the powder has a high oxide content in the form of oxide inclusions which reduces the ductility, impact strength and fatigue strength of densified compacts produced from the powder. It has been found that oxide inclusions are reduced significantly by reducing the amount of these alloying elements present in the melt; however this is not sufficient in itself as it results in the powder having low hardenability. High hardenability is important if good fatigue and wear resistance properties are to be achieved. Consequently, the alloying elements are replaced by appropriate additions of molybdenum, nickel, phosphorous and copper all of which have oxidising potentials similar to or less than that of iron and lead to increased hardenability. These additions are in the ranges: molybdenum 0.2 to 1%, nickel 0.2 to 1.0%, phosphorous up to 0.3% and copper up to 1.0%.

The as-atomised powder is annealed in a hydrogen or dissociated ammonia atmosphere at a temperature typically around 800° C. to soften the individual particles to improve their compressibility. During annealing, the carbon and oxygen contents of the powder are generally reduced and it is usually necessary, therefore, to add graphite to bring the carbon level up to the required specification of approximately 0.9 to 1.1% by weight and also to compensate for carbon losses during subsequent sintering. Typically, if the carbon content of the liquid metal before atomisation is approximately 1.0% by weight up to 0.5% by weight graphite is added.

The annealed powder is formed into compacts related to the required component shape by isostatic pressing or die compaction, which are passed continuously through a furnace on a moving belt and sintered in a hydrogen or dissociated ammonia atmosphere at a temperature typically of 1150° C. for approximately ½ hour. The furnace atmosphere may be enriched by the addition of carbon monoxide or a hydrocarbon gas in order to achieve carbon control during sintering.

Alternatively, the sinter furnace may be a batch furnace or walking beam furnace.

Sintering may also be carried out under sub-atmospheric pressure conditions at a temperature of approximately 1250° C.

It has been found that in order to reduce the oxide content of the compacts to a minimum, it is necessary to employ furnace atmospheres having dewpoints of less than −10° C. preferably less than −20° C. While it would be preferable to operate at the lower dewpoint limit of hydrogen and dissociated ammonia, which as supplied commercially is approximately −70° C., operation of a continuous sinter furnace at dewpoints lower than −40° C. is presently not possible and a figure of −20° C. is that which can be achieved without resort to the use of expensive sealing mechanisms.

After sintering, the compacts are densified to more than 99% of the theoretical density of the material to form the product components.

After densification, the components may be heat treated by heating to a temperature in the range 800° C. to 860° C. followed by quenching in oil or water to give hardness levels in excess of 800 VPM.

Tests carried out on densified articles show that components produced in accordance with the present invention are fully hardened from their centres to their edges at an equivalent bar diameter of 19 mm and have hardness levels better than, or at least equivalent to, those possessed by conventional rolled chromium steels.

The following is one Example of a trial carried out in accordance with the invention.

EXAMPLE 1

A powder having a median particle size in the range 60 to 80 microns and of nominal composition by weight 1% C, 1.5% Cr, 0.5% Mo, 0.02% Si and 0.05% Mn was produced by water atomisation.

The oxygen content of the as-atomised powder was 5250 ppm which, after annealing in a hydrogen atmosphere at 800° C. and slow cooling, reduced to 3100 ppm. The carbon content fell during annealing to 0.75%. The compressibility of the annealed powder was found to be 6.38 gm/cc after compaction at a pressure of 620 $MN/m^2$.

Graphite was mixed with the powder to raise the carbon level to approximately 1.3% by weight to compensate for carbon which would be lost during subsequent sintering.

A quantity of the powder was isostatically compacted at a pressure of 210 $MN/m^2$ to form billets of 75 mm diameter which were then sintered for ½ hr at a temperature of 1150° C. in a hydrogen atmosphere of approximately −30° C. dewpoint.

After sintering, the billets were hot pressed at a pressure of 1000 $MN/m^2$ followed by extrusion to 28 mm diameter at a pressure of 500 $MN/m^2$.

The extruded bars were annealed by heating to 800° C. followed by cooling at 10° per hour down to below 600° C. and then air cooled.

The analysis of the extruded bars was found to be by weight 1.07% C, 0.02% Si, 0.05% Mn, 0.008% S, 0.008% P, 0.02% Ni, 1.39% Cr and 0.52% Mo. The oxygen content was 60 ppm which is similar to that normally obtained in wrought low alloy steels.

After heat treatments comprising heating to 840° C. followed by water and oil quenching and tempering at 175° C., hardness levels of 849 VPN and 810 VPN were respectively achieved. Standard wrought carbon/-chromium steel samples of the same size subjected to identical heat treatment were found to have hardness levels of 810 VPN and 798 VPN respectively.

EXAMPLE 2

A powder produced by water atomisation of the same composition as that referred to in Example 1 was annealed and blended with graphite in substantially the same manner as set out in Example 1. A quantity of the annealed powder was isostatically compacted at a pressure of 210 $MN/m^2$ to form a hollow billet having an external diameter of 75 mm and an internal bore of 28 mm diameter. The billet was sintered in a hydrogen atmosphere with a dew point of approximately −25° C. and subsequently extruded into a length of tube by means of a mandril attached to the extrusion ram, the mandril passing through both the bore of the billet and the extrusion dye. The extruded tube had an outer diameter of 31.25 mm and the bore an inner diameter of 25 mm. The carbon content of the extruded tube was 1.01% and the oxygen content 150 parts per million.

Samples of the tube were annealed by heating to 800° C. followed by cooling at a rate of 10° per hour to below 600° C. and then cooling in air. The annealed hardness of the tube samples was 205 VPN. A number of the annealed samples was hardened by heating to 840° C., quenching into oil and followed by tempering at 175° C. The hardness of the heat treated samples was 870 VPN.

It will be appreciated that components produced from low alloy powders produced in accordance with the method set out above have significantly low oxygen levels, and exhibit good hardness characteristics.

I claim:

1. In a method of manufacturing heat treated hardened steel components comprising the steps of annealing a steel powder in an atmosphere consisting wholly or essentially of hydrogen or dissociated ammonia at a temperature between 700° and 900° C. to produce one or more compacts from the annealed powder, sintering the compacts in an atmosphere consisting wholly or essentially of hydrogen or dissociated ammonia at a temperature between 900° and 1300° C., densifying the sintered compacts and heat treating the densified components, the improvement comprising (i) forming said steel powder by water atomising a prealloyed steel melt to produce a powder consisting of, by weight, from 0.9 to 1.5% carbon, 1.2 to 2.0% chromium, less than 0.05% silicon, less than 0.1% manganese and an element selected from the group consisting of 0.2 to 1.0 molybdenum, 0.2 to 1.0% nickel, up to 0.3% phosphorous, and up to 1.0% copper, and combinations of two or more of said elements, the balance, apart from impurities, being iron, and (ii) sintering the compacts in an atmosphere consisting wholly or essentially of hydrogen or dissociated ammonia having a dewpoint of less than −10° C. at a temperature between 900° and 1300° C., such that the oxygen content of the sintered compacts is reduced to less than 250 parts per million.

2. A method as claimed in claim 1 wherein graphite additions are made to the annealed powder to raise its carbon content to a level which after sintering will result in a carbon content in the range 0.8 to 1.2% by weight.

3. A method as claimed in claim 1 wherein the sintered compacts are densified by either a hot pressing, rolling, forging or extrusion process.

4. A method as claimed in claim 1 wherein the alloy steel melt is atomised by impinging one or more high velocity water jets on to the surface of a stream of the melt falling freely under gravity from a vessel.

5. Compacts manufactured according to the method of claim 1.

* * * * *